US005206618A

United States Patent [19]

Koch

[11] Patent Number: 5,206,618

[45] Date of Patent: Apr. 27, 1993

[54] MAGNETIC LATCH

[75] Inventor: Stuart Koch, Philadelphia, Pa.

[73] Assignee: SPD Technologies Inc., Philadelphia, Pa.

[21] Appl. No.: 798,922

[22] Filed: Nov. 26, 1991

[51] Int. Cl.[5] ..... H01F 7/08

[52] U.S. Cl. ..... 335/253; 335/167

[58] Field of Search ..... 335/167-176, 335/229, 232, 234, 253

[56] References Cited

U.S. PATENT DOCUMENTS

| | | | |
|---|---|---|---|
| 695,539 | 3/1902 | Cook | 335/253 |
| 813,638 | 2/1906 | Fretts | 335/253 |
| 1,907,534 | 5/1933 | Fritcsons | 335/253 |
| 3,069,602 | 12/1962 | Stout et al. | 335/230 |
| 3,114,862 | 12/1963 | Rice | 335/167 |
| 3,984,796 | 10/1976 | Gaskill | 335/229 |
| 4,538,129 | 8/1985 | Fisher | 335/230 |
| 5,027,093 | 6/1991 | Palmer et al. | 335/176 |

*Primary Examiner*—Lincoln Donovan

[57] ABSTRACT

A magnetic latch includes a coil, a frame receiving magnetic flux from the coil when energized, a latching member mounted in the frame and rotatably movable between first and second positions with the latching member providing a magnetic flux bridge between flux carrying means of the frame by contacting the flux carrying means with the latching member is in a first position, a magnet providing magnetic flux carried by the flux carrying means and a portion of the latching member for magnetically retaining the latching member is a first position with the coil is deenergized and a spring biasing the latching member towards a second position with force sufficient to overcome magnetic retention of the latching member at the first position when the coil is providing magnetic flux to the flux carrying members of the frame in the direction opposite of that of flux provided by the magnet.

56 Claims, 5 Drawing Sheets

MAGNETIC LATCH

BACKGROUND

1. Field of the Invention

This invention relates generally to magnetic latches and specifically to magnetic latches useful as tripping actuators in circuit breakers.

2. Description of the Prior Art

Magnetic latches are used as tripping actuators in circuit breakers. Typically magnetic latches store mechanical energy in a spring, for delivery when circuit breaker trip is indicated as a result of an over-current condition.

Magnetic latches can deliver many times more mechanical energy than the equivalent electrical energy required to demagnetize the magnetic latch flux path and hence release the circuit breaker trip mechanism. Magnetic latches effectively amplify and convert low electrical energy input to high mechanical energy output.

Heretofore, magnetic latches for circuit breakers, such as those used by the United States Navy in shipboard applications, have been too large for use in small, molded case circuit breakers. Moreover, known magnetic latches exhibit high flux leakage due to inadequate flux paths and are not balanced against the destabilizing effects of shock, which can be substantial in a combat environment. Furthermore, known magnetic latches, such as found in air circuit breakers used by the United States Navy in shipboard applications, have linear actuators with rectangular shafts protruding from the latch housing to act on the circuit breaker trip mechanism. This results in inefficient use of available space which is at a premium aboard ships.

SUMMARY OF THE INVENTION

A magnetic latch includes a coil and a frame receiving magnetic flux from the coil when the coil is energized. The frame includes spaced-apart magnetically permeable means for carrying flux produced by the coil. A latching member, rotatably mounted in the frame, is movable between first and second positions in response to spring bias. The latching member includes magnetically permeable means for providing a magnetic flux bridge between the spaced-apart flux-carrying means of the frame by contacting those spaced-apart means when the latching member is in the first position.

The magnetic latch further includes means (preferably permanent magnets) for continuously providing magnetic flux to be carried by the flux-carrying means and by the flux-bridging means portion of the latching member when contacting the spaced-apart flux-carrying means. This flux opposes flux provided by the coil when energized and provides magnetic force retaining the latching member in the first position when the coil is not energized.

The magnetic latch further includes means for biasing the latching member from the first position towards the second position with force sufficient to overcome magnetic force retaining the latching member and thereby to move the latching member towards the second position when the coil is energized. The latching member moves in response to the biasing means when the coil is energized; when so-energized, the coil provides magnetic flux to the flux-carrying means in a direction opposite to the flux provided by the permanent magnet. (The coil flux does not substantially pass through the permanent magnet and thereby oppose the permanent magnetic flux within the permanent magnet. If permitted, this would greatly reduce effectiveness of the magnet over time.)

The spaced-apart flux-carrying means are preferably longitudinally spaced and longitudinally aligned high magnetic permeability members. The latching member, providing a flux bridge between the flux-carrying members by contacting the flux-carrying members when in the first position, is spaced from the flux-carrying members when in the second position. Preferably, the latching member is rotatable about an axis parallel with a longitudinal axis defined by the flux carrying members, i.e. an axis directed from one flux-carrying member to another, across the space between them.

The coil is preferably longitudinally elongated.

The frame further preferably includes first and second pairs of longitudinally spaced-apart, longitudinally aligned magnetically permeable members for carrying flux produced by the coil. In such case, the latching member preferably includes a pair of high magnetic permeability means for selectably providing magnetic flux bridges between the members of each pair of flux-carrying members, by contacting both of the flux-carrying members of each of the pairs when the latching member is in the first position.

The magnetic latch is preferably dynamically balanced with moments of inertia of the latching member summing to zero. The latching member is preferably essentially symmetrical about its axis of rotation.

In the embodiment in which the flux carrying means include first and second pairs of spaced-apart magnetically permeable members for carrying flux produced by the coil, a first pair of flux-carrying members is preferably positioned between a first elongated magnet and a first magnetic flux bridging means portion of the latching member; a second pair of flux-carrying members is preferably positioned between a second elongated magnet and a second magnetic flux bridging means portion of the latching member.

The flux-carrying members of the frame longitudinally abut the magnets, at respective magnet ends, over the entire transverse cross-sections of the magnets to minimize flux leakage; this results in a high percentage capture of flux supplied by the magnets.

A preferred embodiment provides a magnetic latch having significantly reduced package size, lower flux leakage and higher shock resistance than magnetic latches known heretofore. The configuration of the latching member produces a dynamically balanced and hence highly shock-resistant mechanism.

In the preferred embodiment of the invention, significantly reduced package size and low flux leakage result from the generally rectangular, parallelepiped configuration of the permanent magnets, the magnetic flux carrying members and the frame from which the magnetic flux carrying members extend and between respective portions of which the permanent magnets are sandwiched. The generally right-angular configuration of the permanent magnets and the frame permits the permanent magnets to abut the frame over the entire cross-sectional area of the permanent magnets. Reduced flux leakage results from this configuration a does small size of the magnetic latch.

The preferred embodiment of the magnetic latch is believed to be about one third the weight of conventional magnetic latches.

In an alternate embodiment of the invention, the magnetic latch includes two coils, positioned on opposite sides of the latching member. The frame is of a shape to accommodate the additional coil. The shape of the frame is generally rectangular with the frame having two components, spaced from one another, which are generally symmetrical respecting each other. Two permanent magnets are sandwiched between the two portions of the frame.

The permanent magnets are preferably of rectangular cross-section and preferably fit flush, in abutment with respective facing surfaces of the two portions of the frame. The generally rectangular configuration of the frame, including the generally rectangular configuration of two flux carrying members which extend from the two frame portions, together with the generally rectangular configuration of the permanent magnets and the flush contact of the permanent magnet ends with the facing surfaces of the frame result in a low flux leakage, highly compact magnetic latch.

In a preferred configuration of the second embodiment, the portion of the magnetic latch on one side of the latching member is substantially identical to the portion on the remaining side of the latching member, when the magnetic latch is considered to be rotated 180° degrees about the latching member axis of rotation. The second embodiment provides additional flux through use of an additional coil, thereby providing a stronger magnetic switch throw while still having a relatively compact, essentially symmetrical shape.

In both embodiments, the magnetic circuit is very short, eliminating excess mass of high magnetic permeability steel, thereby contributing to the compact size and low weight of the magnetic latch.

The invention minimizes magnetic flux losses by using a relatively optimized magnetic flux path having minimal reluctance. The rotary action of the magnetic latch may actuate a circuit breaker trip without occupying space outside the magnetic latch frame envelope. As compared to conventional magnetic latches, the latching member is believed accommodate more magnetic flux. The cross-sectional area of the flux conducting path, being increased relative to prior art magnetic latches, results in less magnetic flux leakage and permits a smaller, more compact magnetic latch than is believed to have been known heretofore.

DESCRIPTION OF THE PREFERRED EMBODIMENTS

Figure 1:
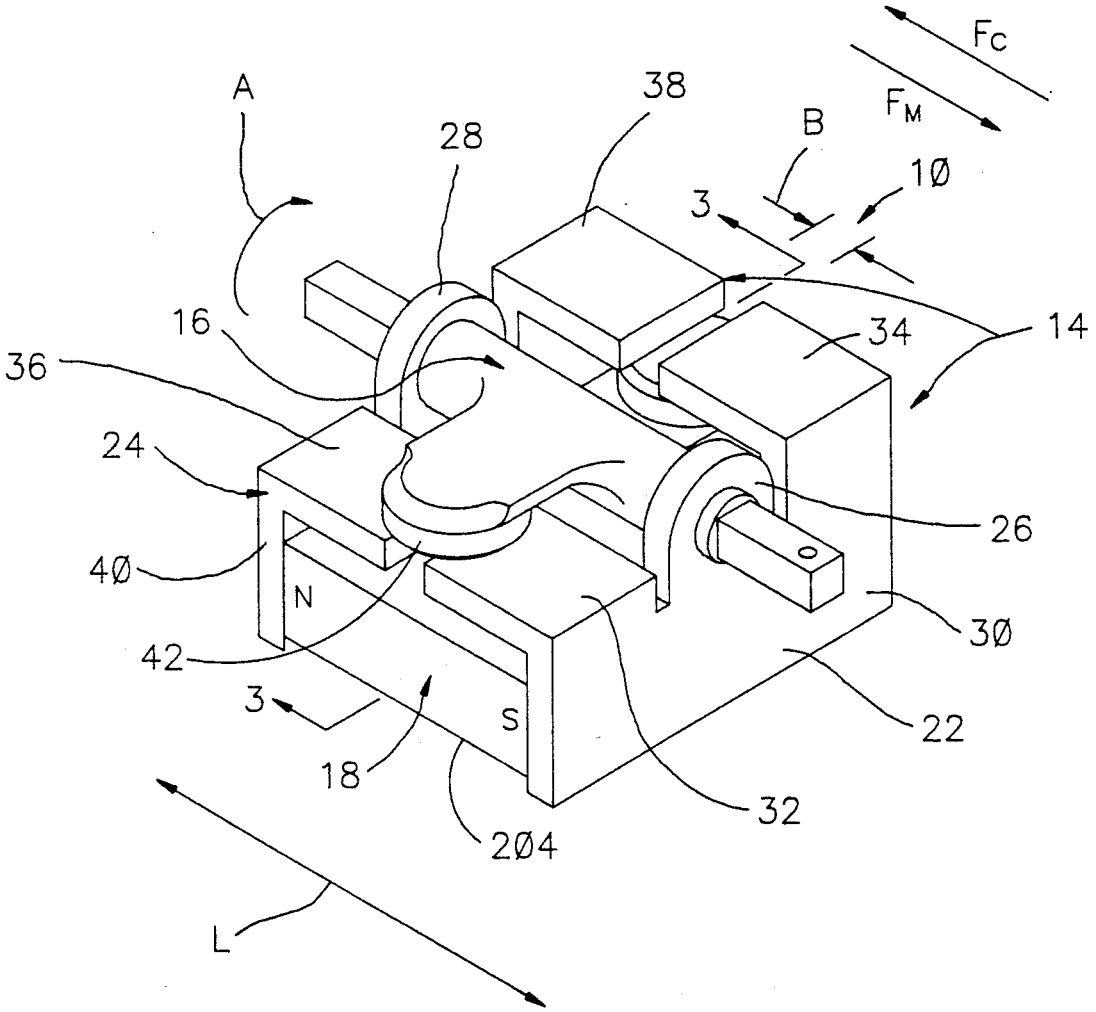
FIG. 1 is an isometric view of a first, preferred embodiment of a magnetic latch of the invention.
Figure 2:
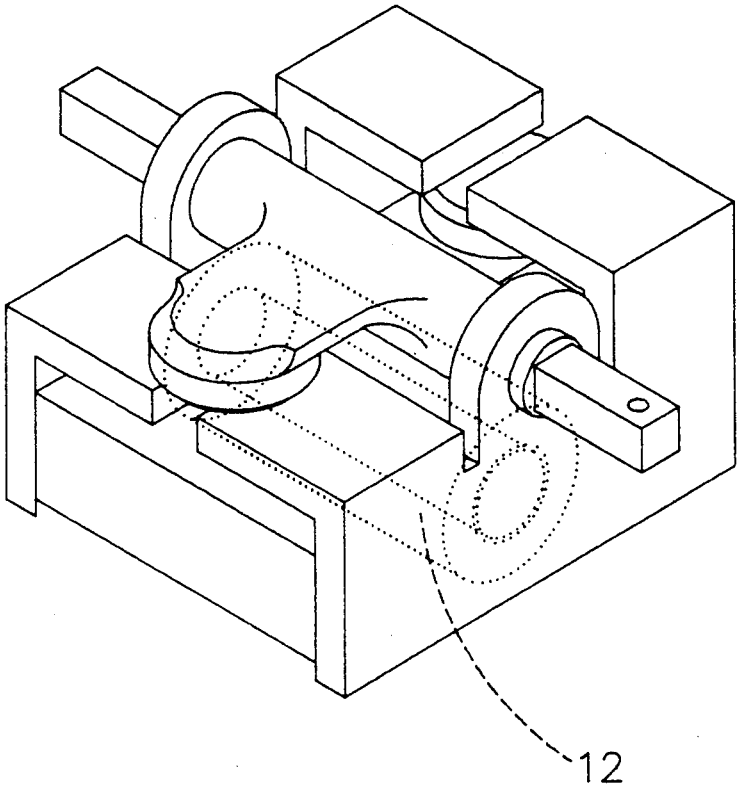
FIG. 2 is an isometric view essentially identical to FIG. 1 and additionally showing, in dotted lines, a coil hidden from view by other components.

Referring to the drawings in general and to FIGS. 1 and 2 in particular, the preferred embodiment of the magnetic latch, which is designated generally 10, includes a two-piece frame 14 and a coil 12, which is not visible in FIG. 1 but is shown in dotted lines in FIG. 2. Magnetic latch 10 further includes a latching member 16 and means, preferably in the form of permanent magnets 18 and 19, for continually providing magnetic flux. (Permanent magnet 19 is hidden from view in FIG. 1.) Magnetic latch 10 still further includes means, not shown in FIG. 1, for biasing latching member 16 from a first position towards a second position. This biasing function is preferably performed by resilient springs 20, 21 illustrated in FIG. 5.

Latching member 16 is illustrated in a first position in FIG. 1. The biasing means, preferably in the form of springs 20, 21, rotatably biases latching member 16 in the direction indicated by arrow A in FIG. 1, towards a latching member second position.

Frame 14 includes longitudinally spaced apart first and second parallel magnetic flux carrying members designated 22 and 24 respectively. Flux carrying members 22, 24 are preferably homogeneous integrally formed one-piece members and are preferably made of high magnetic permeability material, most preferably steel. Flux carrying members 22, 24 include respective upstanding yokes 26, 28 which are integrally formed as parts of members 22, 24. Yokes 26, 28 are bored to receive latching member 16, which is rotatably mounted therewithin.

First magnetic flux carrying member 22 of frame 14 includes a generally upstanding wall portion 30 and integral, parallel cantilevered first and second pediments 32, 34 extending generally transversely from an upper extremity of wall portion 30 as illustrated in FIG. 1. Both of pediments 32, 34 are formed integrally with first magnetic flux carrying member 22.

In FIG. 1, double ended arrow L denotes the longitudinal direction. First and second cantilevered pediments 32, 34 of first magnetic flux carrying member 22 extend parallel with each other and longitudinally towards corresponding respective first and second parallel cantilevered pediments 36, 38 of second magnetic flux carrying member 24. Pediments 32, 34 are respectively separated from pediments 36, 38 by a distance indicated by dimensional arrows B in FIG. 1. First and second cantilevered pediments 36, 38 extend from an upstanding wall portion 40 of second magnetic flux carrying member 24.

First cantilevered pediments 32, 36 (of first and second magnetic flux carrying members 22 and 24 respectively) ar part of a flux path and define a first pair of longitudinally aligned, spaced-apart magnetically permeable members for carrying flux produced by coil 12 and by magnet 18. Similarly, second cantilevered pediments 34, 38 (of first and second flux carrying members 22 and 24 respectively) define a second pair of longitudinally aligned, spaced-apart magnetically permeable members for carrying flux produced by coil 12 and by magnet 19.

Both cantilevered pediment 32 and cantilevered pediment 36 are preferably of rectangular cross-section with flux flowing through first cantilevered pediments 32 and 36 in the longitudinal direction indicated generally by arrow L. Permanent magnet 18 also preferably has rectangular cross-section in the transverse direction respecting longitudinal arrow L. As a result of the flush contact of the ends of permanent magnet 18 with the interior facing surfaces of first and second magnetic flux carrying members 22, 24 and as a result of the integral formation of first cantilevered pediments 32, 36 with wall portions 30, 40 of first and second flux carrying members 22, 24, flux flows in a first flux path, which is defined generally by first pediments 32, 36 and the portions of walls 30, 40 within the envelope defined by the transverse width of first cantilevered pediments 32, 36. Arrow $F_M$ in FIG. 1 schematically illustrates the manner in which flux flows along a portion of this first flux path.

The means for continually providing magnetic flux is preferably two longitudinally elongated permanent magnets, preferably having generally rectangular transverse cross-sections. These permanent magnets are designated 18 and 19 and abut upstanding wall portions 30, 40 at respective magnet ends, as illustrated in FIG. 4.

Figure 3:
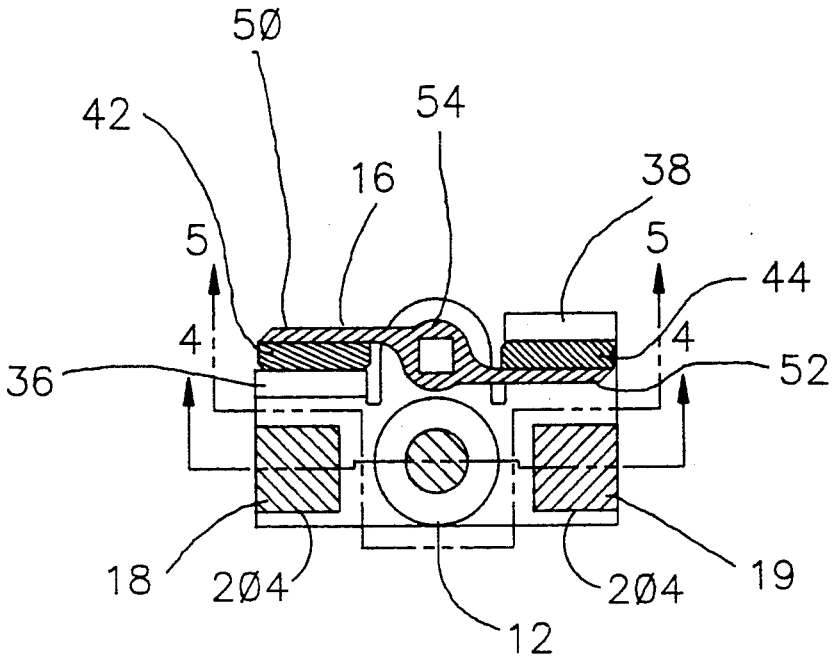
FIG. 3 is a section at arrows 3—3 in FIG. 1.
Figure 4:
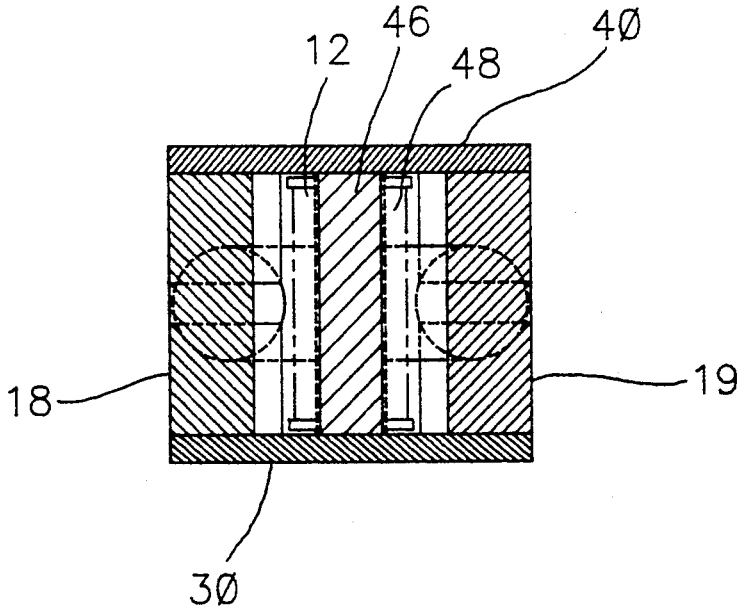
FIG. 4 is a section at arrows 4—4 in FIG. 3.

Positioning magnets 18, 19 to facingly contact wall portions 30, 40 over the entire transverse cross-section of magnets 18, 19, as illustrated in FIGS. 3 and 4, minimizes magnetic flux leakage and maximizes magnetic flux transfer from magnets 18, 19 into upstanding walls 30, 40 of members 22, 24 respectively. Members 22, 24, being integral, unitary and homogeneous in their preferred construction, efficiently carry magnetic flux through respective upstanding wall portions 30, 40 to first cantilevered pediments 32, 36 and to second cantilevered pediments 34, 38.

To minimize package size of the magnetic latch illustrated in FIG. 1, bottom surfaces of members 22, 24 may be positioned in alignment with the corresponding planar bottom surface 204 of permanent magnet 18.

Attached to latching member 16 are a pair of magnetically permeable bridging members 42 and 44 for providing magnetic flux bridges between first pediments 32 and 36 and between second pediments 34 and 38. As illustrated in FIGS. 1 and 3, when latching member 16 is in the first position, bridging members 42, 44 contact first pediments 32, 36 and second pediments 34, 38 respectively, providing magnetic flux bridges therebetween by bridging the gaps, indicated by dimensional arrows B, separating the respective pediments.

Resilient means 20 biases latching member 16 from the first position, in which latching member 16 is illustrated in FIGS. 1, 2, 3, 4 and 5, towards a second position, to which latching member 16 rotates in the direction indicated by arrow A in FIG. 1. When latching member 16 is in the first position, bridging members 42, 44 facingly contact respective pediments 32, 36 and 34, 38. Thus, when latching member 16 is in the first position, the magnetic circuits defined (i) by pediment 32, bridging member 42 and pediment 36 (together with portions of the respective magnetic flux carrying members 22, 24 within the transverse projections of pediments 32, 26) and (ii) by pediment 34, bridging member 44 and pediment 38 (together with the portions of respective magnetic flux carrying members 22, 24 which are within the transverse projections of pediments 34, 38), are closed.

When latching member 16 is in the second position, bridging members 42, 44 are spaced from and do not contact either first pediments 32, 36 or second pediments 34, 38. Thus, when latching member 16 is in the second position, the magnetic circuits defined (i) by pediment 32, bridging member 42 and pediment 36 and (ii) by pediment 34, bridging member 44 and pediment 38, are broken.

As illustrated schematically in FIG. 4, coil 12 includes a magnetic core 46 with windings 48 wrapped thereabout.

Magnets 18, 19, when positioned with their north and south poles as illustrated by letters N and S in FIGS. 1 and 4, produce magnetic flux in flux paths defined by first pediments 32, 36 with first bridging member 42 and defined by second pediments 34, 38 with second bridging member 44, in the direction indicated by arrow $F_M$ in FIG. 1. Coil 12 is wound so that when energized it produces magnetic flux through the flux paths defined by first pediments 32, 36 with first bridging member 42 and by second pediments 34, 38 with second bridging member 44, in the direction indicated by arrow $F_C$ in FIG. 1.

Flux in the direction indicated by arrow $F_C$ from coil 12 opposes flux in the direction indicated by arrow $F_M$ from magnets 18, 19 in these two flux paths. As a result, when coil 12 is energized, net magnetic flux through the two magnetic paths which include bridging members 42, 44 is reduced. Reduction in net flux through the flux paths reduces magnetic force retaining bridging members 42, 44 in contact with first pediments 32, 36 and second pediments 34, 38 respectively.

This reduction in magnetic retention force (when coil 12 is energized) is sufficient that resilient means 20, 21 overcome the magnetic force tending to retain bridging members 42, 44 of latching member 16 in place; resilient means 20, 21 move latching member 16 to the second position by rotating latching member 16 in the direction indicated by arrow A in FIG. 1.

Latching member 16 is preferably longitudinally elongated and is preferably rotatable about its longitudinal axis. Coil 12 is also preferably longitudinally elongated, as are magnets 18, 19.

As illustrated in FIG. 3, the longitudinal axes of latching member 16 and coil 12 define a plane orthogonal to a plane containing the longitudinal axes of magnets 18, 19 and coil 12. Moreover, the longitudinal axes of magnets 18, 19, coil 12 and latching member 16 are all preferably parallel. The preferable rectangular cross-sectional shape of magnets 18, 19 results in the longitudinally extending surfaces of magnets 18, 19 being in planes either perpendicular to or parallel with a plane containing the longitudinal axes of latching member 16 and coil 12.

As illustrated in FIGS. 1 and 3, the first pair of flux-carrying members defined by pediments 32, 36 are inboard of first bridging means 42 relative to first permanent magnet 18, while the second pair of flux carrying members defined by second pediments 34, 38 are outboard of second bridging member 44 relative to second magnet 19.

Central portion 54 and wings 50, 52 of latching member 16 are preferably integrally fabricated of a unitary homogeneous piece of substantially non-magnetic stainless steel. Bridging members 42, 44 mounted on wings 50, 52 are preferably electrical iron (as is the magnetic core of coil 12) but may also be some other high magnetic permeability material. First and second members 22, 24 of frame 14 are integral homogeneous preferably high magnetic permeability steel.

The moments of inertia of latching member 16 preferably sum to zero about the longitudinal (rotational) axis of latching member 16. Moreover, latching member 16 is substantially symmetrical about its axis of rotation. This results in latching member 16, which is the only moving part of magnetic latch 10, being dynamically balanced. Hence, the magnetic latch is inherently highly shock resistant.

The assembly consisting of magnetic flux carrying members 22, 24 defining frame 14, magnets 18, 19 and coil 12 may be connected together by screws extending longitudinally into and through these members. Such screws have not been illustrated in the drawings, to aid clarity.

As illustrated in FIG. 3, wing portions 50, 52 of latching member 16, to which first and second bridging members 42, 44 are secured, extend outwardly from a central longitudinally elongated portion 54 of latching member 16 at positions transversely offset from the longitudinal axis of latching member 16.

The generally rectangular transverse cross-section of first and second cantilevered pediments 32, 36 and 34, 38 results in efficient magnetic flux carriage through and transfer by these members. Moreover, use of two wings 50 and 52 and associated respective bridging members 42 and 44, extending from latching member 16, permits more magnetic flux to be handled than in known magnetic latches. The high cross-sectional area (in the direction of flux flow) of the flux path defined by cantilevered pediments 32, 34, 36, 38 results in low flux leakage and provides a very compact magnetic latch.

As further illustrated in FIG. 3, the traverse offset configuration of wings 50, 52 respecting the axis of rotation of latching member 16, whereby wings 50, 52 are transversely offset from the axis of rotation of latching member 16 a distance substantially equal to the transverse thickness of bridging members 42, 44, promotes surface contact, rather than line contact, between bridging members 42, 44 and cantilevered pediments 32, 34, 36, 38. This results in symmetrical application of force to latching member 16 when latching member 16 moves between the first and second positions, further enhancing the shock resistant character of the magnetic latch.

Figure 5:
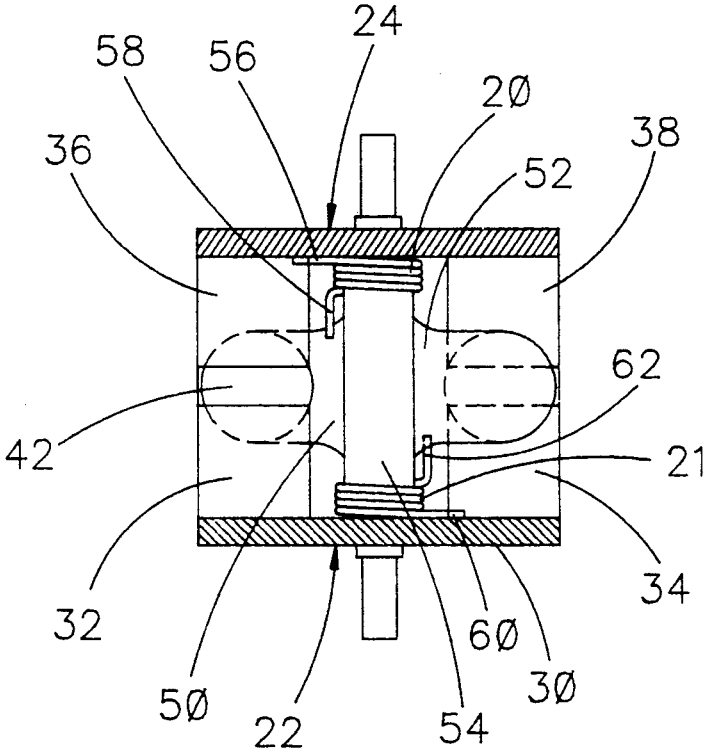
FIG. 5 is a section at arrows 5—5 in FIG. 3.

As illustrated in FIG. 5, dual coil springs 20, 21 wrap around central portion 54 of latching member 16. Springs 20, 21 have end portions 56, 60 and 58, 62 respectively abutting undersides of cantilevered pediments 34, 36 extending from members 22, 24 and the undersides of respective wings 50, 52 of latching member 16. Springs 20, 21 bias latching member 16 from the first position, in which latching member 16 is illustrated in FIGS. 1 through 5, towards the second position as discussed above. (Latching member 16 is not illustrated in the second position in drawing FIGS. 1 through 5, but a corresponding latching member is illustrated in the second position in FIG. 7 with respect to the second embodiment.) This movement is accomplished by respective ends 56, 58, 60, 62 of springs 20, 21 biasingly contacting pediments 34, 36 and wings 50, 52 respectively, thereby applying bias to latching member 16. While springs 20, 21 have been illustrated located within the envelope defined by the magnetic latch periphery, this is not necessary. Either or both of springs 20, 21 can be external springs, if desired.

The second embodiment, which is an alternate preferred embodiment, differs from the first embodiment principally in that it uses two coils instead of one and in that the frame of the second embodiment, when viewed as being rotated one-hundred eighty degrees about the latching member axis of rotation, appears identically the same as in its non-rotated position.

Figure 7:
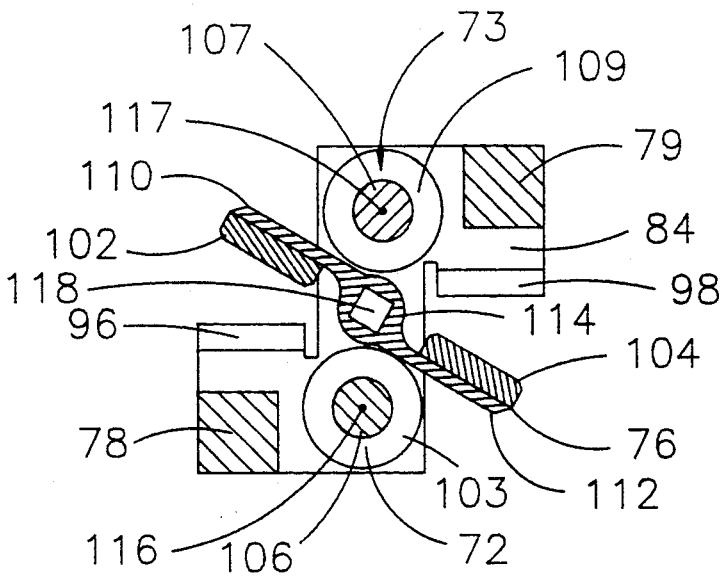
FIG. 7 is a sectional view of the embodiment of FIG. 6, taken at arrows 7—7 in FIG. 6.
Figure 6:
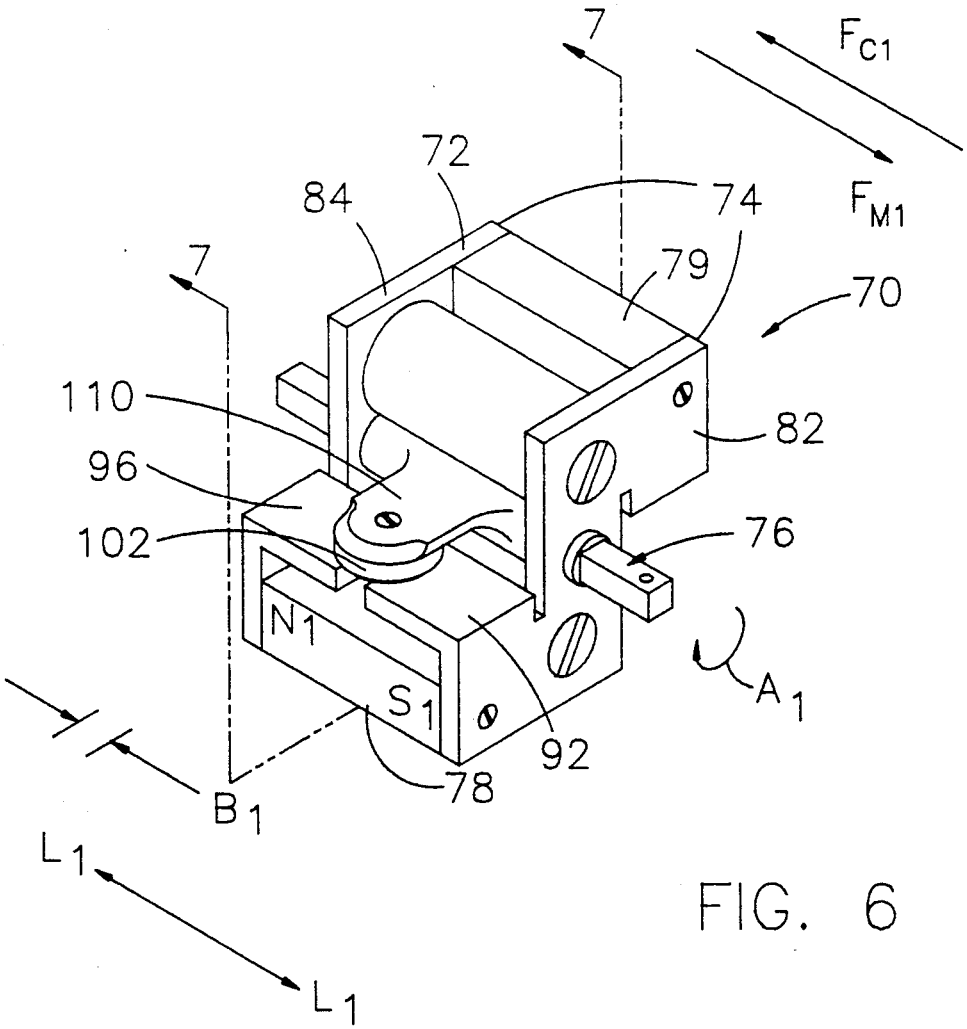
FIG. 6 is an isometric view of a second embodiment of the magnetic latch of the invention.

FIGS. 6 and 7 illustrate the second embodiment. The second embodiment of the magnetic latch is designated generally 70 and includes a two-piece frame 74 and two coils 72, 73. Only coil 72 is visible in FIG. 6; both coils 72 and 73 are shown in cross-section in FIG. 7. Magnetic latch 70 further includes a rotatable latching member 76 and means, preferably in the form of longitudinally elongated, rectangular cross-section permanent magnets 78 and 79, for continually providing magnetic flux.

Magnetic latch 70 further includes means, not shown in FIG. 6 or FIG. 7, for biasing latching member 76 from a first position to a second position. FIG. 6 shows latching member 76 in the first position whereas FIG. 7 shows latching member 76 in the second position. The biasing means may be resilient means such as springs positioned as shown in FIGS. 4 and 5 and as described above in connection with the first preferred embodiment. The biasing means acts to rotate latching member 76 in a direction indicated by arrow A in FIG. 6, towards the second position illustrated in FIG. 7.

Frame 74 includes first and second magnetic flux carrying members generally designated 82 and 84 respectively. Members 82, 84 are preferably parallel, longitudinally spaced apart, homogeneous and fabricated of a high magnetic permeability material such as steel. Members 82, 84 are bored to receive latching member 76 which is rotatably mounted therein.

First flux carrying member 82 of frame 74 is preferably generally in the form of a substantially upstanding wall having two integral parallel pediments, extending in cantilever fashion in the same direction, from member 82. Only one of the pediment portions of first flux carrying member 82 is visible in FIG. 6; it has been numbered 92.

Similarly, second flux carrying member 84 of frame 74 is also preferably generally in the form of a substantially upstanding wall having two integral preferably parallel pediments. Only one of these pediments is visible in FIG. 6; that pediment has been numbered 96. Pediment 96 and the pediment portion (of second flux carrying member 84) which is hidden from view in FIG. 6 both extend in cantilever fashion in the same direction from second flux carrying member 84.

Flux carrying members 82, 84 have generally S-shaped profiles. The cantilevered pediments of the respective flux carrying members 82, 84 extend generally transversely from the tips of the S-shaped profile of flux carrying members 82, 84 as shown in FIGS. 6 and 7.

In FIG. 6, doubled ended arrow $L_1$—$L_1$ denotes the longitudinal direction. First cantilevered pediment 92 of flux carrying member 82 extends longitudinally toward corresponding first cantilevered pediment 96 of flux carrying member 84. Pediments 92 and 96 are preferably aligned with each other but are separated from one another by a distance indicated by dimensional arrow $B_1$ in FIG. 6. The same is true of the remaining pair of pediments which cannot be seen in FIG. 6; one of these pediments is numbered 98, extends in cantilever fashion outwardly from second flux carrying member 84 and is shown in FIG. 7

First cantilevered pediments 92, 96 (of flux carrying members 82 and 84 respectively) are part of a flux path and define a first pair of longitudinally aligned, spaced apart magnetically permeable members for carrying flux produced by coil 72 and by magnet 78. Similarly, the second cantilevered pediments (of members 82 and 84 respectively) which are not visible in FIG. 6 (but one of which, namely second pediment 98, is visible in FIG. 7) are also part of a flux path, which is a second flux path, and define a second pair of longitudinally aligned, spaced apart magnetically permeable members for carrying flux produced by coil 73 and by magnet 79.

As with the first preferred embodiment, the means for continually providing magnetic flux are preferably two longitudinally elongated permanent magnets preferably having generally rectangular transverse cross-sections. These permanent magnets 78 and 79 abut flux carrying members 82, 84 at respective magnet ends as illustrated in FIG. 6.

As shown in FIGS. 6 and 7, latching member 76 includes a pair of magnetically permeable bridging members 102 and 104 for providing magnetic flux bridges between the respective first pediments 92, 96 and between the respective second pediments.

When latching member 76 is in the first position as illustrated in FIG. 6, first bridging member 102 bridges the gap between pediments 92 and 96, which gap is indicated by dimensional arrow $B_1$ in FIG. 6. When latching member 76 is in the second position bridging member 102 is spaced from and does not contact either of first pediments 92, 96, as generally illustrated in FIG. 7.

First and second permanent magnets 78, 79, when positioned with their north and south poles as illustrated by letters $N_1$ and $S_1$ in FIG. 6, produce magnetic flux in flux paths defined by first pediments 92, 96 with bridging member 102 and by the second pediments, one of which is numbered 98, with second bridging member 104, in the direction indicated by arrow $F_{M1}$ in FIG. 6. Coils 72 and 73 are wound so that when energized they produce magnetic flux through the flux paths defined by first pediments 92, 96 together with bridging member 102 and by the second pediments together with bridging member 104, in the direction indicated by arrow $F_{C1}$ in FIG. 6.

As illustrated in section in FIG. 7, coils 72 and 73 include respective magnetic cores 106, 107 and windings 108, 109 respectively wrapped around those cores. Coils 72, 73 function in the same manner as coil 12 described above in connection with the first embodiment. Specifically, when energized coils 72, 73 produce magnetic flux opposing magnetic flux produced by magnets 78, 79 in the flux paths. Thus, when coils 72, 73 are energized, the net flux, i.e. the algebraic sum of the fluxes $F_{C1}$ and $F_{M1}$, through the flux paths is reduced. As a result, magnetic force resulting from the magnetic flux flowing through the flux paths is insufficient to hold bridging members 102 and 104 in the first position illustration in FIG. 6. That is, the force applied by the resilient means to latching member 76 is greater than the net magnetic flux and, therefore, the resilient means moves latching member 76 rotatably to the second position illustrated in FIG. 7.

Latching member 76 is longitudinally elongated and rotatable about its longitudinal axis shown as 118 in FIG. 7. Coils 72 and 73 are also longitudinally elongated and may be considered to have respective coil longitudinal axes shown as 116 and 117 in FIG. 7. Further, magnets 78, 79 are also longitudinally elongated Preferably, latch axis 118, coil axes 116, 117 and the longitudinal axes of magnets 78, 79 are all substantially parallel.

Latching member 76 has a central portion 114, has first and second wings 110, 112 and is preferably integrally fabricated from a unitary homogeneous piece of non-magnetic stainless steel. First and second bridging members 102, 104, mounted on first and second wings 110, 112 respectively, are preferably electrical iron but may be some other high magnetic permeability material. First and second magnetic flux carrying members 82, 84 collectively defining frame 74 are preferably unitary, integral homogeneous pieces of high magnetic permeability steel.

The moments of inertia of latching member 76 preferably sum to zero about the longitudinal axis of rotation 118 of latching member 76. Moreover, latching member 76 is substantially symmetrical about its axis of rotation. As a result, latching member 76 is dynamically substantially balanced.

First cantilevered pediments 92, 96 are positioned between first bridging means 102 and first permanent magnet 78 while, in contrast to the first embodiment, the second pediments (one of which is visible in FIG. 7 as 98) are also positioned between second bridging means 104 and second permanent magnet 79. As with the first embodiment, when latching member 76 is in the first position, contact between respective bridging members 102, 104 and respective first cantilevered pediments 92, 96 and the two second cantilevered pediments is surface contact rather than line contact, due to the configuration of latching member 76 with wings 110, 112 transversely offset from the latching member axis of rotation.

As with the first embodiment, the embodiment illustrated in FIGS. 6 and 7 provides a highly compact magnetic latch. The compact character of the magnetic latch results in large measure from the essentially orthogonal or largely perpendicular geometry of the component parts of the magnetic latch. Specifically, first and second magnetic flux carrying members 82, 84 are fabricated so that the edges thereof are all substantially parallel or perpendicular one to another. First and second magnetic flux carrying members 82, 84 are further fabricated so that they are both largely planar and can be secured in position parallel to one another.

Permanent magnets 78, 79 are fabricated to be of generally rectangular, preferably square, cross-section, as illustrated in FIG. 7 and are longitudinally elongated so as to fit between first and second magnetic flux carrying members and to flushly contact first and second magnetic flux carrying members 82, 84 over the facing surfaces thereof.

The first and second cantilevered pediments extending from first and second magnetic flux carrying members 82, 84 towards respective remaining flux carrying members 82, 84 are cantilevered from respective flux carrying members 82, 84 at substantially 90 degree angles. Respective pediments extending from respective first and second magnetic flux carrying members are essentially aligned and parallel with one another. This substantially orthogonal geometric configuration, as illustrated in FIGS. 6 and 7, contributes to the highly compact character of the magnetic latch of this invention. The first embodiment also exhibits this substantially orthogonal geometric configuration, as illustrated in FIGS. 1 through 5.

The edges of the respective components constituting the magnetic latch of the invention have no been numbered in the drawings depicting either the first or the second embodiment of the invention. These edges have not been numbered in order to enhance drawing clarity. However, as is apparent from the drawings, when the magnetic latch of the invention is fabricated in either of the two disclosed and preferred embodiments, edges of respective adjoining components of the magnetic latch are generally co-linear or perpendicular and coplanar. For example, in FIG. 6 first and second magnetic flux carrying members 82, 84 have upwardly facing edges which quite visible in FIG. 6 and define two parallel, rectangular, transversely elongated, upwardly facing surface portions of first and second magnetic flux carrying members 82, 84 respectively. The shorter edges of these two upwardly facing surfaces (which edges are unnumbered in FIG. 6) at the portions of those surfaces more remote from the viewer, are depicted as colinear with a line defining a corner of second permanent magnet 79 in FIG. 6. This co-linearity of the corner of second permanent magnet 79 with the corners of first and second magnetic flux carrying members 82, 84 (defined by the shorter lines bounding the two transversely elongated, generally upwardly facing rectangular surfaces of first and second magnetic flux carrying members 82, 84 in FIG. 6), contributes to the compact character of the magnetic latch of the invention.

These same geometric principles are carried out throughout the two embodiments of the invention, as illustrated in the drawings. This geometric configuration contributes to the compact package and high magnetic flux transmission efficiency, with minimal flux losses, exhibited by the magnetic latch apparatus of the invention in its embodiments.

While the preferred embodiment of the invention has been described above and an alternative embodiment has also been described, the scope of protection to which the invention is entitled is defined by the claims, and by equivalents thereto which perform substantially the same function in substantially the same way to achieve substantially the same result as set forth in the claims, so long as such substantial equivalents, as defined by a claim for such substantial equivalent, do not read on the prior art.

The following is claimed:

1. A magnetic latch comprising:

a. a coil;

b. a frame receiving magnetic flux from said coil when energized, including spaced apart magnetically permeable means for carrying said coil flux;

c. a latching member mounted in said frame and rotatably movable between first and second positions;

d. said latching member including magnetically permeable means for selectably providing a magnetic flux bridge between said flux carrying means by contacting said flux carrying means when in said first position;

e. means providing magnetic flux, carried by said flux carrying means and said magnetically permeable bridging means portion of said latching member when in contact with said flux carrying means, opposing magnetic flux provided by said coil, for magnetically retaining said latching member in said first position when said coil is deenergized; and f. resilient means for biasing said latching member towards said second position with force sufficient to overcome magnetic retention of said latching member at said first position when said coil is providing magnetic flux to said flux carrying members, in direction opposite that of said flux providing means, through said magnetically permeable bridging means.

2. The magnetic latch of claim 1 wherein a. said spaced apart magnetically permeable means of said frame include longitudinally spaced apart magnetically permeable members; and b. said latching member provides a magnetic flux bridge between said flux carrying members by contacting longitudinally spaced apart magnetically permeable member portions of said flux carrying members when in said firs position.

3. The magnetic latch of claim 2 wherein said latching member is rotatable about an axis parallel with a longitudinal axis defined by said longitudinally spaced apart magnetically permeable member portions of said flux carrying members.

4. The magnetic latch of claim 3 wherein said flux carrying members comprise two longitudinally spaced apart members.

5. The magnetic latch of claim 4 wherein said coil is elongated along an axis.

6. The magnetic latch of claim 5 wherein said magnetic flux providing means includes a longitudinally elongated permanent magnet.

7. The magnetic latch of claim 6 wherein said latching member axis and an axis of said coil define a plane orthogonal to a plane containing a longitudinal axis of said magnet and said coil axis.

8. The magnetic latch of claim 7 wherein said longitudinally spaced apart magnetically permeable member portions of said flux carrying members are longitudinally aligned.

9. The magnetic latch of claim 2 wherein said magnetic flux providing means includes a longitudinally elongated permanent magnet, with longitudinal axes of said magnet and said coil being coplanar.

10. The magnetic latch of claim 9 wherein:

a. said magnetic flux providing means includes a second longitudinally elongated permanent magnet having a longitudinal axis; and b. said magnet axes and the coil axis are coplanar.

11. The magnetic latch of claim 10 wherein said magnet longitudinal axes and said coil axis are parallel.

12. The magnetic latch of claim 11 wherein an axis of rotation of said latching member is parallel with said magnet axes.

13. The magnetic latch of claim 12 wherein said latching member axis of rotation and said coil axis define a plane orthogonal to a plane containing said magnet axes and said coil axis.

14. The magnetic latch of claim 6 wherein moments of inertia of said latching member sum to zero.

15. The magnetic latch of claim 6 wherein latching member has two-fold rotational symmetry about its axis of rotation.

16. A magnetic latch comprising:

a. a pair of coils;

b. a frame receiving magnetic flux from said coils when energized, including first and second pairs of spaced apart magnetically permeable members for carrying flux produced by said coil;

c. a latching member mounted in said frame and rotatably movable between first and second positions about a longitudinal axis;

d. said latching member including a pair of magnetically permeable bridging means for providing a pair of magnetic flux bridges between said flux carrying members by each magnetically permeable bridging means contacting both of said flux carrying members when the latching member is in said first position;

e. first and second means for providing magnetic flux carried by said flux carrying members and said magnetically permeable bridging means when in contact with the flux carrying members, in a direction opposing magnetic flux provided by said coils, for magnetically retaining said latching member in said first position when said coils are not energized;

f. resilient means for biasing said latching member from said first position towards said second position with force sufficient to overcome said magnetic retention of said latching member and thereby move said latching member towards said second position when said coils are providing magnetic flux to said flux carrying members in a direction opposing the flux from said flux providing means;

g. first portions of said flux carrying members being between a first one of said magnetic flux providing means and a first one of said bridging means; and h. second portions of said flux carrying members being positioned between a second one of said magnetic flux providing means and a second one of said bridging means.

17. The magnetic latch of claim 16 wherein said coils are elongated in a direction substantially parallel to the axis of rotation of the latching member.

18. The magnetic latch of claim 17 wherein said magnetic flux providing means includes permanent magnets elongated in a direction substantially parallel to the axis of rotation of the latching member.

19. The magnetic latch of claim 18 wherein said latching member axis and an axis of either of said coils define a plane orthogonal to a plane containing longitudinal axes of said magnets and said selected coil axis.

20. The magnetic latch of claim 19 wherein said longitudinal magnet axes and said coil axes are parallel.

21. The magnetic latch of claim 20 wherein said latching member axis is parallel with said magnet axes.

22. The magnetic latch of claim 21 wherein moments of inertia of said latching member sum to zero.

23. The magnetic latch of claim 21 wherein latching member has two-fold symmetry about its axis of rotation.

24. A shock resistant magnetic latch comprising:

a. a coil;

b. a magnetically permeable frame;

c. first and second elongated permanent magnets mounted in said frame;

d. said frame including first and second pairs of spaced members, aligned parallel with a direction of elongation of the permanent magnets, for carrying flux when provided by said coil and for respectively carrying flux provided by said first and second magnets;

e. portions of said frame respectively abutting ends of said first and second magnets over the entire magnet cross-section perpendicular to the direction of elongation of said magnets at said ends so that respective frame portions abut an opposite end of a respective magnet;

f. a latching member rotatably moveable in said frame between first and second positions about an axis parallel with the direction of elongation of said magnets;

g. said latching member including a pair of magnetically permeable means for providing magnetic flux bridges between the flux carrying members by contacting both flu carrying members of each pair when the latch member is in said first position;

h. said first and second elongated magnets providing magnetic flux, carried by said flux carrying members and said magnetically permeable bridging means when in contact with the flux carrying members, opposing magnetic flux from said coil, for magnetically retaining said latching member in said first position when said coil is not energized;

i. means for biasing said latching member from said first position towards said second position with force sufficient to overcome said magnetic retention of said latching member and thereby move said latching member towards said second position when said coil provides magnetic flux to said flux carrying members in a direction opposing flux from said magnets;

j. said first magnet and a first one of said bridging means; said first magnet and a first one of said bridging means;

k. said second pair of flux carrying members being between said second magnet and a second one of said bridging means.

25. The magnetic latch of claim 24 wherein said biasing means is resilient.

26. The magnetic latch of claim 25 wherein:

a. said latching member axis of rotation and an axis of said coil define a plane orthogonal to a plane containing longitudinal axes of said magnets and said coil axis;

b. said latching member axis is parallel with said magnet axes;

c. moments of inertia of said latching member sum to zero; and d. said latching member has two-fold symmetry about its axis of rotation.

27. A magnetic latch comprising:

a. a coil;

b. spaced apart magnetically permeable frame means for carrying flux produced by said coil when energized;

c. rotatable means, mounted in said frame means and movable between first and second positions, for providing a magnetic flux bridge between said spaced apart frame means when in said first position;

d. means continuously providing magnetic flux, carried by said frame means and said rotatable means when contacting said frame means, opposing coil-produced magnetic flux in said rotatable means, for magnetically retaining said rotatable means in said first position when said coil is not energized; and e. means for biasing said rotatable means towards said second position with force sufficient to overcome said magnetic retention and move said rotatable means towards said second position when said coil is providing magnetic flux to said frame means opposing flux from said flux providing means.

28. The magnetic latch of claim 27:

a. wherein said frame means includes spaced apart magnetically permeable members; and b. wherein said rotatable means provides a magnetic flux bridge between said spaced apart magnetically permeable members by contacting said members when in said first position.

29. The magnetic latch of claim 28 wherein said rotatable member is rotatable about an axis parallel with a direction of shortest distance between said spaced apart magnetically permeable members at said area of contact.

30. The magnetic latch of claim 29 wherein said coil is elongated.

31. The magnetic latch of claim 30 wherein said continuous magnetic flux providing means includes an elongated permanent magnet.

32. The magnetic latch of claim 31 wherein said rotatable member axis and an axis of said coil define a plane orthogonal to a plane containing a longitudinal axis of said magnet and said coil axis.

33. The magnetic latch of claim 32 wherein said spaced apart magnetically permeable members are aligned and substantially parallel with the coil axis.

34. The magnetic latch of claim 33 wherein said magnet longitudinal axis and said coil axis are parallel.

35. The magnetic latch of claim 34 wherein said rotatable member axis is parallel with said magnet axis.

36. The magnetic latch of claim 35 wherein the rotatable member has two-fold symmetry about its axis of rotation.

37. A magnetic latch comprising:

a. a coil;

b. frame means receiving magnetic flux from said coil when energized and including spaced apart means for carrying flux produced when said coil is energized;

c. pivoting means mounted in said frame and movable through an arc between first and second positions for providing a magnetic flux bridge between said flux carrying means by substantially facing contact with said flux carrying means when in said first position;

d. means for continuously providing magnetic flux carried by said flux carrying means and said pivoting means when in contact with the flux carrying means, opposing flux provided by said coil, sufficient for magnetically retaining said pivoting means in said first position when said coil is deenergized; and e. means biasing said pivoting means towards said second position with force sufficient to overcome said magnetic retention of said pivoting means when said coil is providing magnetic flux.

38. The magnetic latch of claim 37:

a. wherein said spaced apart means includes magnetically permeable rectangular solid members spaced apart symmetrically on opposite sides of an imaginary plane of reflection;

b. wherein said pivoting member provides a magnetic flux bridge between said solid members by facingly contacting respective parallel extending surfaces of said solid members when in said first position.

39. The magnetic latch of claim 38 wherein said pivoting member rotates about an axis perpendicular to said imaginary plane.

40. The magnetic latch of claim 39 wherein said solid members each comprise parallel extending surfaces and a solid, rectangular cross section perpendicular to said extending surfaces, and are located such that said extending surfaces extend from said perpendicular portions toward said imaginary plane, the extending surfaces are parallel to the plane of contact with said pivoting member, and the perpendicular portions are parallel with each other and are located in reflectively symmetric positions on opposite sides of the imaginary plane.

41. The magnetic latch of claim 40 wherein said coil is elongated and parallel to said axis of rotation.

42. The magnetic latch of claim 41 wherein said magnetic flux providing means includes an elongated permanent magne perpendicularly abutting two parallel, non-coplanar, rectangular cross section solid portions of said flux carrying means.

43. The magnetic latch of claim 42 wherein said pivoting member axis of rotation and an axis of said coil define a plane orthogonal to a plane containing an axis of said magnet and said coil axis.

44. The magnetic latch of claim 43 wherein said non-coplanar, rectangular cross section solid portions contact said permanent magnet over the entire transverse cross section of said permanent magnet at respective magnet ends defining respective poles of said magnet.

45. The magnetic latch of claim 44 wherein said transverse cross section of said permanent magnet is rectangular.

46. The magnetic latch of claim 45 wherein said transverse cross section of said permanent magnet is square.

47. The magnetic latch of claim 46 wherein edges of said square transverse cross section of said permanent magnet are coincident with edges of said non-coplanar, rectangular cross section solid portions of said flux carrying means.

48. The magnetic latch of claim 47 wherein said coil is between said parallel, non-coplanar, rectangular cross section planar portions of said flux carrying means.

49. A magnetic latch comprising:

a. two coils each having an axis of elongation;

b. a magnetically permeable frame including two substantially identical facing segments spaced apart from each other on opposite sides of an imaginary plane of reflection;

c. a rotatable latch member having an axis of rotation and substantial two-fold rotational symmetry about said axis of rotation, rotatably connected to said frame;

d. magnetically permeable wing pieces connected to opposite sides of the latch member in a manner to substantially preserve rotational symmetry of the member;

e. two elongated permanent magnets having planar end cross sections abutting inner surfaces of said frame segments, said magnets intersecting said imaginary plane of reflection;

f. said frame segments being spaced apart and said latch member and wing pieces being located so that when the latch member is in a first position, said wing pieces bridge space between said frame segments and make facing contact with the frame segments, establishing two paths for magnetic flux supplied by said magnets;

g. biasing springs at opposite ends of the latch member imposing force on the latch which if unopposed would move the latch to a second position at which said wing pieces are spaced from said frame segments.

50. The magnetic latch of claim 49 wherein the permanent magnets provide sufficient flux that when the latch member is in the first position the flow of flux through the paths provides a sufficient retention force on the wing pieces to oppose the bias force and keep the latch member in the first position provided the coils are not energized.

51. The magnetic latch of claim 50 wherein the coils are positioned near portions of the flux paths formed by the wing pieces when the latch member is in the first position whereby, on being energized, the coils provide flux opposing the flux from the permanent magnets at said portions of the flux paths.

52. The magnetic latch of claim 49 wherein each frame segment includes a first planar portion parallel to said imaginary plane and second and third planar portions, wherein the second and third portions are both perpendicular to the first planar portion, parallel to each other, extend from the first planar portion perpendicularly toward the imaginary plane and are parallel to surfaces of the wing pieces contacting the second and third portions when the latch member is in the first position.

53. The latch of claim 52 wherein the second and third portions of one of the frame members are located on the opposite side of the imaginary plane from the second and third portions of the other frame member respectively such that a frame member on one side of the imaginary plane is a substantial reflection of the frame member on the opposite side of the plane

54. The latch of claim 52 wherein the second and third portions do not contact the magnets.

55. The latch of claim 51 wherein the coils occupy corresponding positions on opposite sides of the latch member and are parallel to the rotational axis of the latch member such that the axes of both coils and said rotational axis are substantially coplanar and parallel.

56. The latch of claim 55 wherein the lath has substantial two-fold rotational symmetry about the rotational axis of the latch member.

* * * * *